US007385559B2

(12) United States Patent
Kanagawa et al.

(10) Patent No.: US 7,385,559 B2
(45) Date of Patent: Jun. 10, 2008

(54) ANTENNA FEED STRUCTURE

(75) Inventors: Kiyoshi Kanagawa, Yokohama (JP); Masanobu Okada, Sagamihara (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 11/573,519

(22) PCT Filed: Jul. 13, 2005

(86) PCT No.: PCT/JP2005/012944

§ 371 (c)(1),
(2), (4) Date: Feb. 9, 2007

(87) PCT Pub. No.: WO2006/027895

PCT Pub. Date: Mar. 16, 2006

(65) Prior Publication Data

US 2007/0241974 A1 Oct. 18, 2007

(30) Foreign Application Priority Data

Sep. 10, 2004 (JP) ..... 2004-264175

(51) Int. Cl.
*H01Q 1/24* (2006.01)

(52) U.S. Cl. ..... 343/702; 343/906

(58) Field of Classification Search ..... 343/702, 343/906

See application file for complete search history.

(56) References Cited

U.S. PATENT DOCUMENTS 5,949,377 A * 9/1999 Matsumoto et al. ..... 343/702
6,618,013 B1 9/2003 Aldous (Continued)

FOREIGN PATENT DOCUMENTS

JP 55-64275 5/1980

(Continued)

OTHER PUBLICATIONS

International Search Report with English language translation issued Aug. 30, 2005.

(Continued)

*Primary Examiner*—Hoanganh Le
(74) *Attorney, Agent, or Firm*—Obstrolenk, Faber, Gerb & Soffen, LLP

(57) ABSTRACT

In an antenna feed structure for electrically connecting a rotatable antenna to a circuit formed on a circuit board by means of a feeding metallic part, an antenna rotary shaft formed so as to protrude from one end of the antenna and formed of a conductor has a preferably spherical end. The feeding metallic part has a mounting portion, an antenna contact-and-connection portion, and an elastic supporting portion. The mounting portion is mounted to the circuit board. The antenna contact-and-connection portion is brought into contact with and is connected to the end of the antenna rotary shaft. The elastic supporting portion supports the antenna contact-and-connection portion at the mounting portion and produces biasing force towards the antenna rotary shaft from the antenna contact-and-connection portion. The antenna contact-and-connection portion has a recess wall preferably having a spherical shape which is in correspondence with the spherical shape of the end of the antenna rotary shaft. The spherical end of the antenna rotary shaft press-contacts the spherical recess wall of the antenna contact-and-connection portion.

15 Claims, 7 Drawing Sheets

U.S. PATENT DOCUMENTS

| | | | | |
|---|---|---|---|---|
| 2002/0021254 | A1* | 2/2002 | Wang et al. | 343/715 |
| 2007/0146214 | A1* | 6/2007 | Yuba et al. | 343/702 |

FOREIGN PATENT DOCUMENTS

| | | |
|---|---|---|
| JP | 1-126086 | 8/1989 |
| JP | 7-311827 | 11/1995 |
| JP | 11-504771 | 4/1999 |
| JP | 2001-69029 | 3/2001 |
| JP | 2001-339211 | 12/2001 |
| JP | 2002-50915 | 2/2002 |
| WO | WO96/23327 | 8/1996 |

OTHER PUBLICATIONS

European Search Report issued Nov. 22, 2007.

* cited by examiner

ANTENNA FEED STRUCTURE

CROSS-REFERENCE TO RELATED APPLICATIONS

The present application is a 35 U.S.C. § 371 national phase conversion of PCT/JP2005/012944 filed on Jul. 13, 2005, which claims priority of JP2004-264175 filed Sep. 10, 2004, incorporated by reference.

BACKGROUND OF THE INVENTION

1. Technical Field

The present invention relates to an antenna feed structure for electrically connecting a rotatable antenna to a circuit on a circuit board, the connection being made with a feeding metallic part on the circuit board.

2. Background Art

FIG. 9 is a schematic view externally showing a card device in simplified form. A card device 41 comprises a card case 42, a circuit board 43 accommodated in the card case 42, and an antenna 44 rotatably disposed at the outer side of the card case 42 for being electrically connected to a circuit (not shown) formed on the circuit board 43.

An antenna rotary shaft 45 formed of a conductor is formed so as to protrude from one end of the antenna 44, and a through hole for inserting the antenna rotary shaft 45 into the card case 42 from outside the card case 42 is formed in a side wall of the card case 42. The antenna rotary shaft 45 is electrically connected to the circuit at the circuit board 43 by inserting the antenna rotary shaft 45 into the card case 42 through the through hole for inserting the antenna rotary shaft. As a result, the antenna 44 is electrically connected to the circuit on the circuit board 43 through the antenna rotary shaft 45.

Other antenna feed structures of background interest are described in Japanese Unexamined Patent Application Publication No. 2001-339211, and PCT Japanese Translation Patent Publication No. 11-504771.

The antenna rotary shaft 45 rotates. Therefore, due to various reasons arising from the rotation of the antenna rotary shaft 45, it is not desirable to directly connect the antenna rotary shaft 45 to the circuit board 43. Consequently, the use of a feeding metallic part such as a feeding metallic part 46 shown in a model diagram in FIG. 10 has been proposed. The feeding metallic part 46 electrically connects the antenna rotary shaft 45 to the circuit at the circuit board 43, so that the antenna rotary shaft 45 is not directly connected to the circuit board 43.

The entire feeding metallic part 46 is formed of a conductor. The feeding metallic part 46 comprises a mounting portion 47 for mounting to the circuit board 43, an antenna contact-and-connection portion 48 for contact and connection with the antenna rotary shaft 45, and an elastic supporting portion 49 for elastically supporting the antenna contact-and-connection portion 48 at the mounting portion 47. The elastic supporting portion 49 possesses elasticity (springiness) allowing biasing force to be produced from the antenna contact-and-connection portion 48 towards the antenna rotary shaft 45.

The mounting portion 47 of the feeding metallic part 46 is electrically connected to the circuit on the circuit board 43. By bringing the antenna rotary shaft 45 into press-contact with the antenna contact-and-connection portion 48 of the feeding metallic part 46, they are electrically connected together. This causes the antenna 44 to be electrically connected to the circuit on the circuit board 43 through the antenna rotary shaft 45 and the feeding metallic part 46.

Accordingly, when the feeding metallic part 46 shown in FIG. 10 is used, the antenna 44 is electrically connected to the circuit on the circuit board 43 without directly connecting the antenna rotary shaft 45 to the circuit board 43. However, when the feeding metallic part 46 shown in FIG. 10 is used, the following problems arise.

Whereas an end surface of the antenna rotary shaft 45 is spherical, a portion of contact of the antenna contact-and-connection portion 48 of the feeding metallic part 46 with the antenna rotary shaft is planar. Therefore, the antenna rotary shaft 45 and the antenna contact-and-connection portion 48 of the feeding metallic part 46 are in point contact with each other, as a result of which the area of contact is very small. In addition, since the antenna rotary shaft 45 tends to swing due to the rotation of the antenna 44, when the antenna 44 rotates, the location of contact of the antenna contact-and-connection portion 48 of the feeding metallic part 46 with the antenna rotary shaft 45 tends to vary. These two problems, that is, the problem of the area of contact between the antenna rotary shaft 45 and the antenna contact-and-connection portion 48 being small and the problem of the location of contact of the antenna contact-and-connection portion 48 with the antenna rotary shaft 45 varying, make it difficult to provide stable contact and electrical connection between the antenna rotary shaft 45 and the antenna contact-and-connection portion 48 (that is, stably electrically connect the antenna 44 and the circuit on the circuit board 43).

Further, the distance between the circuit board 43 and the antenna rotary shaft 45 is determined by various factors. Because allowance must be made for the distance between the circuit board 43 and the antenna rotary shaft 45, the design of the feeding metallic part 46 cannot be carried out with much freedom. When one tries to vary the contact pressure between the antenna rotary shaft 45 and the antenna contact-and-connection portion 48 of the feeding metallic part 46, the design of the feeding metallic part 46 is changed, for example, to vary the location where the feeding metallic part 46 is mounted to the circuit board 43 or to vary the elastic force of the elastic supporting portion 49 of the feeding metallic part 46. However, since the distance between the circuit board 43 and the antenna rotary shaft 45 is small, a range in which the mounting location of the feeding metallic part 46 can be moved is small. Therefore, the contact pressure between the antenna rotary shaft 45 and the antenna contact-and-connection portion 48 substantially cannot be adjusted by adjusting the mounting location of the feeding metallic part 46. Still further, since the feeding metallic part 46 is designed considering various factors, such as material costs and manufacturing process, the feeding metallic part 46 is designed under many constraints. Therefore, it is difficult to change the design for varying the elastic force of the elastic supporting portion 49. Consequently, the structure of the feeding metallic part 46 shown in FIG. 10 has the problem that it is difficult to adjust the contact pressure between the antenna rotary shaft 45 and the antenna contact-and-connection portion 48 of the feeding metallic part 46.

SUMMARY OF THE INVENTION

The invention addresses the aforementioned problems. According to an example of the invention, an antenna feed structure electrically connects a rotatable antenna to a circuit formed on a circuit board by means of a feeding metallic part. In the antenna feed structure, an antenna rotary shaft formed of a conductor is formed so as to protrude from one end of the antenna, an end of the antenna rotary shaft being rounded or preferably spherical. The feeding metallic part has a mounting portion, an antenna contact-and-connection portion, and an elastic supporting portion. The mounting portion is mounted to the circuit board. The antenna contact-and-connection portion is brought into contact with and is connected to the end of the antenna rotary shaft. The elastic supporting portion supports the antenna contact-and-connection portion at the mounting portion and produces biasing force towards the antenna rotary shaft from the antenna contact-and-connection portion. The antenna contact-and-connection portion of the feeding metallic part has a recess wall having a rounded or preferably spherical shape which is in correspondence with the rounded or spherical shape of the end of the antenna rotary shaft. Thus, in this example, the spherical end of the antenna rotary shaft is connected to the antenna contact-and-connection portion by press-contacting the spherical end of the antenna rotary shaft against the spherical recess wall of the antenna contact-and-connection portion.

According to this example of the present invention, an end of the antenna rotary shaft formed so as to protrude from one end of the antenna is spherical. The antenna contact-and-connection portion of the feeding metallic part that the end of the antenna rotary shaft comes into contact with and is connected to has a recess wall having a spherical shape corresponding with the spherical shape of the end of the antenna rotary shaft. The spherical end of the antenna contact-and-connection portion is formed so as to allow it to press-contact the spherical recess wall of the antenna contact-and-connection portion. By this structure, the curved end of the antenna rotary shaft and the curved wall of the antenna contact-and-connection portion contact each other, thereby making it possible to increase the area of contact compared to when the planar surface and the curved surface contact each other.

Since the antenna contact-and-connection portion is supported by the elastic supporting portion, elastic deformation of the elastic supporting portion allows the position of the antenna contact-and-connection portion to be moved. The movability of the position and the press-contacting of the curved surface of the antenna rotary shaft and the curved wall of the antenna contact-and-connection portion make it possible to provide the following advantages. The antenna rotary shaft and the antenna contact-and-connection portion are in a most stable state when the end of the antenna rotary shaft is in press-contact with the deepest portion of the spherical recess wall of the antenna contact-and-connection portion. However, when the antenna rotary shaft swings due to the rotation of the antenna or the position of the antenna rotary shaft is shifted during an assembly process, the state of contact and connection between the antenna rotary shaft and the antenna contact-and-connection portion may become unstable. In such a case, in this example, the end of the antenna rotary shaft relatively moves by itself towards the deepest portion of the recess wall by sliding along the spherical recess wall of the antenna contact-and-connection portion, and/or the antenna contact-and-connection portion shifts slightly to follow the swinging of the antenna rotary shaft. Therefore, their positions can be self-corrected so that the state of contact and connection between the antenna rotary shaft and the antenna contact-and-connection portion is highly stable. In other words, the distinctive structure according to this example of the invention makes it possible to self-align the antenna rotary shaft and the antenna contact-and-connection portion.

As mentioned above, the structure described above makes it possible to increase the area of contact between the antenna rotary shaft and the antenna contact-and-connection portion and to perform self-alignment of the antenna rotary shaft and the antenna contact-and-connection portion. Therefore, it is possible to increase the stability of contact and connection between the antenna rotary shaft and the feeding metallic part (antenna contact-and-connection portion). That is, it is possible to increase the reliability with which the antenna and the circuit on the circuit board are electrically connected.

Also, with this structure, merely by adjusting the depth of the recess wall of the antenna contact-and-connection portion, it is possible to variably adjust the contact pressure between the antenna contact-and-connection portion and the antenna rotary shaft. For a given position of the end of the antenna rotary shaft, if the depth of the recess wall of the antenna contact-and-connection portion of the feeding metallic part is changed, the amount of elastic deformation of the elastic supporting portion is also changed, so as to change the biasing force towards the antenna rotary shaft from the antenna contact-and-connection portion (that is, the contact pressure between the antenna contact-and-connection portion and the antenna rotary shaft). Since the depth of the recess wall of the antenna contact-and-connection portion can be easily varied (that is, the design can be easily changed), the contact pressure between the antenna contact-and-connection portion and the antenna rotary shaft is easily adjusted to a required contact pressure.

In addition, for example, when a design change for changing the distance between the end of the antenna rotary shaft and the circuit board causes a change in the contact pressure between the antenna rotary shaft and the antenna contact-and-connection portion, it is desirable to restore the previous contact pressure while still using the feeding metallic part used prior to the change in the design. To this end, the antenna rotary shaft can easily be brought into contact with and be connected to the antenna contact-and-connection portion under a contact pressure that is the same as that prior to the change in the design, merely by variably adjusting the depth of the recess wall of the antenna contact-and-connection portion. In other words, the exemplary structure described above makes it possible to quickly adjust to a change in the design.

Other features and advantages of the present invention will become apparent from the following description of embodiments of the invention which refers to the accompanying drawings.

DETAILED DESCRIPTION OF EMBODIMENTS OF THE INVENTION

Embodiments of the invention will hereunder be described with reference to the drawings.

Figure 1:
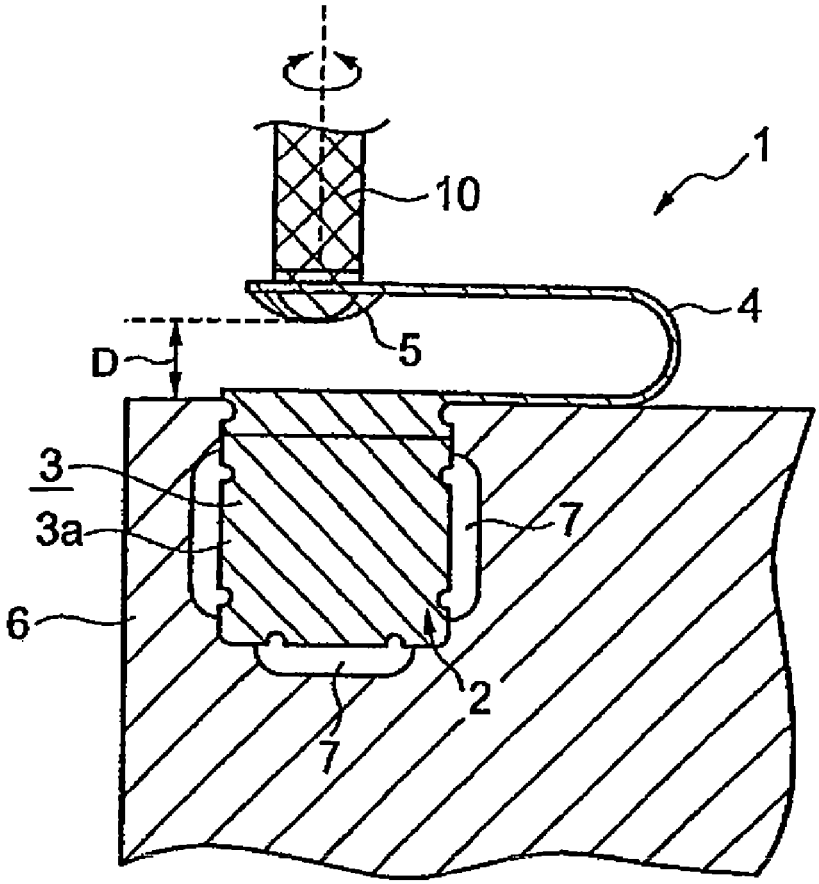
FIG. 1 is a schematic plan view illustrating an antenna feed structure according to a first embodiment.
Figure 2A:
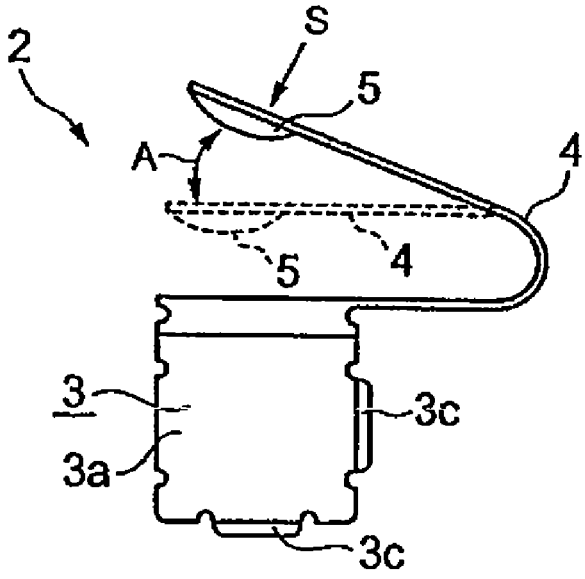
FIG. 2*a* is a plan view illustrating a feeding metallic part of the antenna feed structure according to the first embodiment.
Figure 2B:
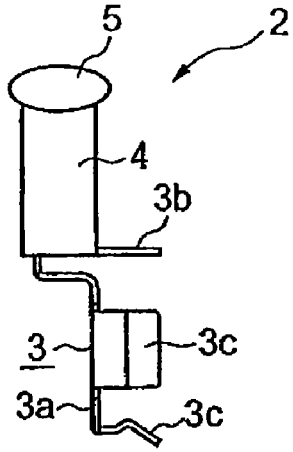
FIG. 2*b* is a side view illustrating the feeding metallic part of the antenna feed structure according to the first embodiment.
Figure 9:
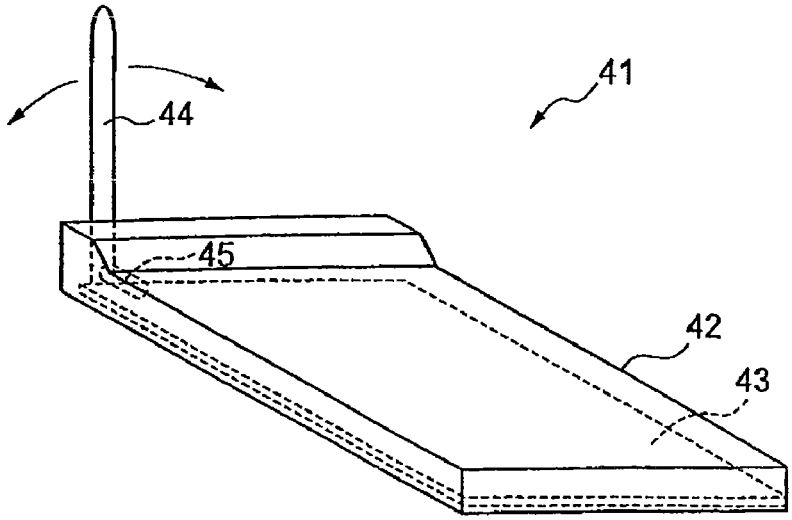
FIG. 9 PRIOR ART
FIG. 9 is a model view schematically illustrating a known card device including an antenna feed structure.
Figure 10:
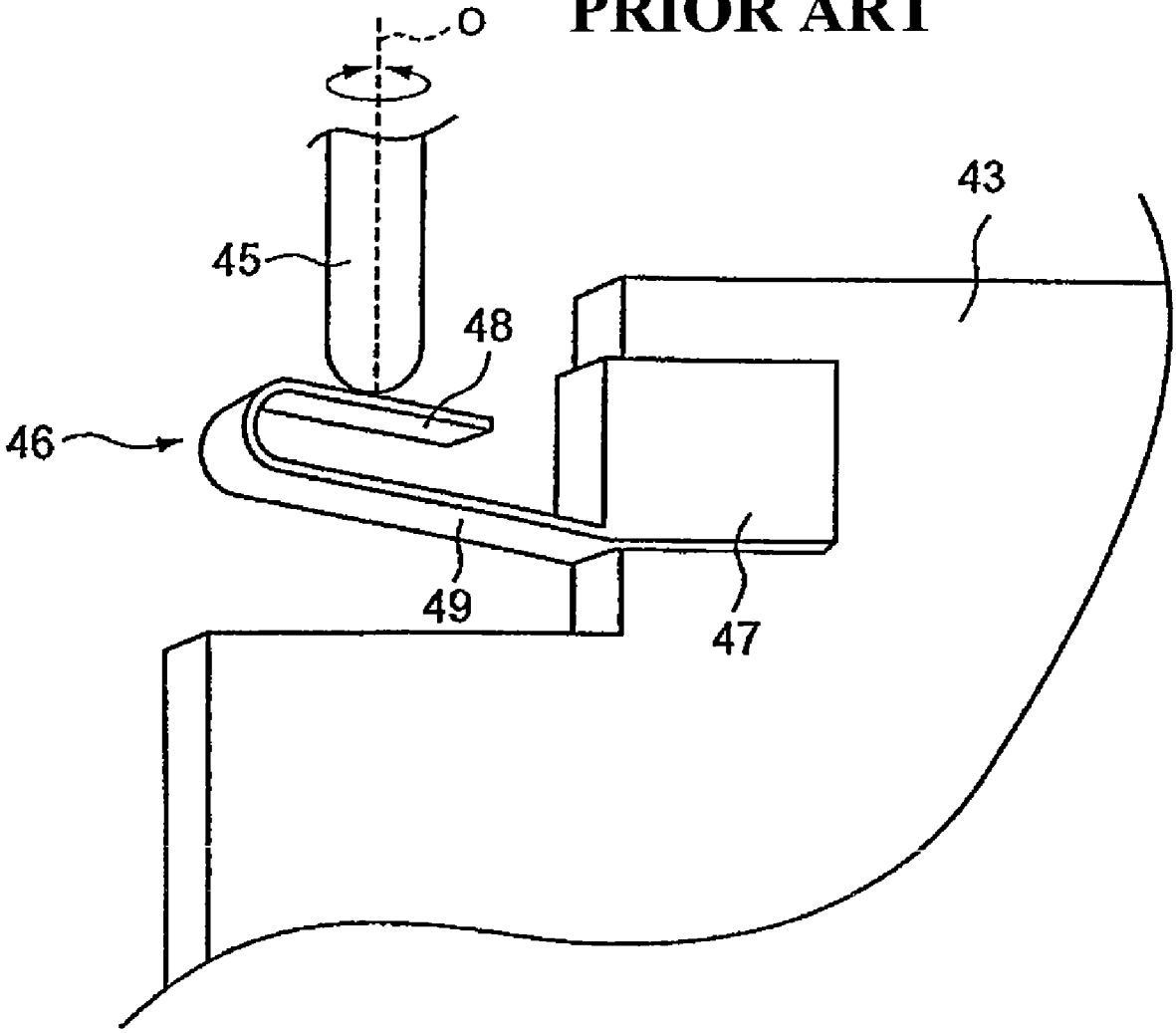
FIG. 10 PRIOR ART
FIG. 10 is a model view illustrating an example of a known feeding metallic part.

FIG. 1 is a schematic plan view illustrating an antenna feed structure according to a first embodiment. An antenna feed structure 1 according to the first embodiment is installed in a device such as a card device having a wireless communication function (for example, a PC card). An example of the card device is shown in FIG. 9. The antenna feed structure 1 has a feeding metallic part 2 for electrically connecting a rotatable antenna to a circuit formed at a circuit board. FIG. 2*a* is a schematic plan view showing the feeding metallic part 2. FIG. 2*b* is a schematic side view showing the feeding metallic part 2 as seen from the right of FIG. 2*a*.

The entire feeding metallic part 2 is formed of a conducting plate, and comprises a mounting portion 3 for mounting to the circuit board, an elastic supporting portion 4 formed so as to extend from the mounting portion 3, and an antenna contact-and-connection portion 5 disposed at an end of the extending portion of the elastic supporting portion 4.

More specifically, the mounting portion 3 is a structural portion for mounting the feeding metallic part 2 to the circuit board. As long as the mounting portion 3 is formed so as to allow the feeding metallic part 2 to be mounted to the circuit board, the structure of the mounting portion 3 is not particularly limited. In FIG. 1, FIG. 2*a*, FIG. 2*b*, and other drawings, the mounting portion 3 has a square flat portion 3*a*, a positioning plate 3*b* formed by bending one side of the flat portion 3*a* substantially perpendicularly to the flat portion 3*a*, and a leg 3*c* formed so as to extend from the other side of the flat portion 3*a* in the same direction as the direction of protrusion of the positioning plate 3*b*.

As shown in FIG. 1, with the flat portion 3*a* of the mounting portion 3 being disposed so as to oppose a wall of a circuit board 6, a surface of the positioning plate 3*b* contacting an end face of the circuit board 6, and the leg 3*c* being inserted in a feeding metallic part mounting hole 7 formed in the circuit board 6, the mounting portion 3 is disposed at the circuit board 6. An electrode pad (not shown) functioning as an antenna connecting portion of the circuit formed on the circuit board 6 is formed on the wall of the circuit board 6 where the mounting portion 3 is disposed. By joining the electrode pad and the mounting portion 3 with a conductive joining material such as solder, the feeding metallic part 2 is secured to the circuit board 6 and is electrically connected to the circuit formed at the circuit board 6.

In the first embodiment, the elastic supporting portion 4 of the feeding metallic part 2 is formed of a plate material formed so as to extend from a side edge of the positioning plate 3*b* of the mounting portion 3. The plate material extending from the side edge of the positioning plate 3*b* bends back in the direction of the end of the extending portion. The elastic supporting portion 4 formed of the plate material is disposed so that a surface of the plate material extends along the end face of the circuit board 6. A portion of the elastic supporting portion 4 disposed closer to the end than the portion where the elastic supporting portion 4 is bent back (bent portion) is elastically movable in the directions of a double-headed arrow A shown in FIG. 2*a* due to elastic deformation of the bent portion.

Figure 2C:
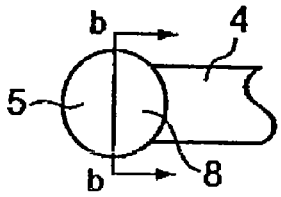
FIG. 2*c* is an enlarged plan view of an antenna contact-and-connection portion of the feeding metallic part of the antenna feed structure according to the first embodiment.
Figure 2D:
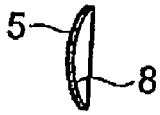
FIG. 2*d* is a schematic sectional view taken along the double-headed arrow b-b shown in FIG. 2*c*.

In the first embodiment, an antenna rotary shaft 10 is formed so as to protrude from one end of the antenna, and has a spherical end (refer to FIG. 1). The antenna contact-and-connection portion 5 is disposed at the end of the extending portion of the elastic supporting portion 4, and is a portion for contact and connection with the end of the antenna rotary shaft 10. FIG. 2*c* schematically shows the antenna contact-and-connection portion 5 as seen in the direction of arrow S shown in FIG. 2*a*, and FIG. 2*d* is a schematic sectional view taken along a double-headed arrow b-b shown in FIG. 2*c*.

The antenna contact-and-connection portion 5 has a recess wall 8 having a spherical shape which is in correspondence with the spherical shape of the end of the antenna rotary shaft 10. The end of the antenna rotary shaft 10 comes into press-contact with the recess wall 8. In the first embodiment, the recess wall 8 is formed by extrusion. A curvature radius R of the spherical shape of the recess wall 8 is larger than a curvature radius r of the spherical shape of the end of the antenna rotary shaft 10 (that is, R>r).

In the first embodiment, in the antenna feed structure, biasing force is applied to the end of the antenna rotary shaft 10 from the antenna contact-and-connection portion 5 on the basis of the elastic force at the bent portion of the elastic supporting portion 4 so as to maintain a stable state of contact and connection between the end of the antenna rotary shaft 10 and the recess wall 8 of the antenna contact-and-connection portion 5. The magnitude of the biasing force can be adjusted not only by, for example, the rigidity of the elastic supporting portion 4, but also by the depth of the recess wall 8. This is because the depth of the recess wall 8 is involved in determining the amount of elastic deformation of the bent portion of the elastic supporting portion 4.

Figure 3A:
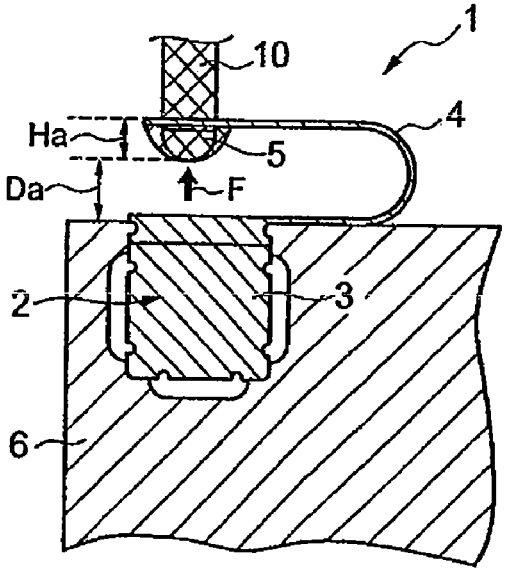
FIG. 3*a* illustrates, along with FIG. 3*b*, an example of adjusting the contact pressure between an antenna rotary shaft and the antenna contact-and-connection portion in the antenna feed structure according to the first embodiment.
Figure 3B:
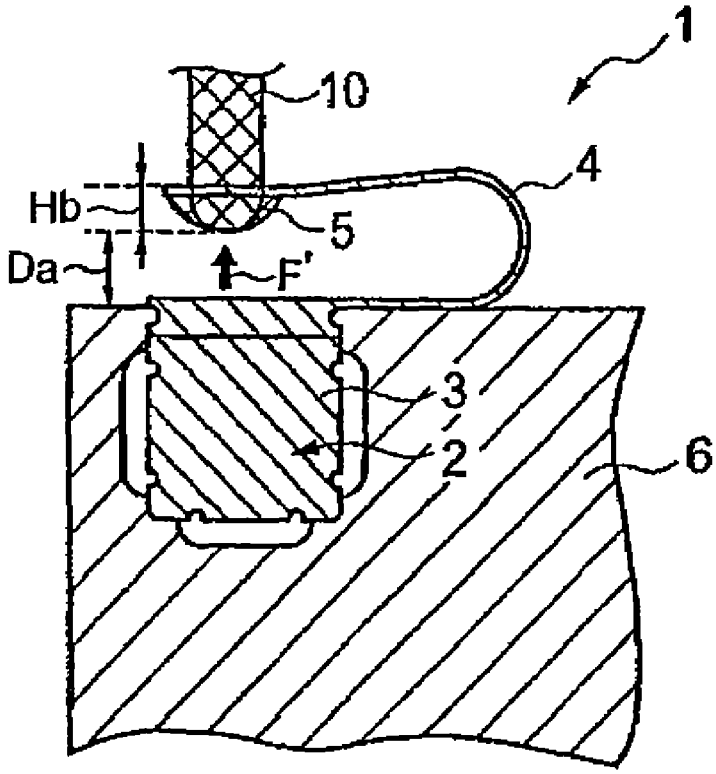
FIG. 3*b* illustrates, along with FIG. 3*a*, the example of adjusting the contact pressure between the antenna rotary shaft and the antenna contact-and-connection portion in the antenna feed structure according to the first embodiment.

In an example shown in FIG. 3*a*, the distance between the end of the antenna rotary shaft 10 and the end face of the circuit board 6 is Da, and the depth of the recess wall 8 of the antenna contact-and-connection portion 5 is Ha. In this state, the magnitude of the biasing force towards the antenna rotary shaft 10 from the antenna contact-and-connection portion 5 (that is, the contact pressure) is F. In contrast, in FIG. 3*b*, a depth Hb of the recess wall 8 of the antenna contact-and-connection portion 5 is less than the depth Ha of the recess wall 8 shown in FIG. 3*a*. This is the only difference between the conditions shown in FIGS. 3*a* and 3*b*. In the case shown in FIG. 3*b*, since the recess wall 8 of the antenna contact-and-connection portion 5 is shallower, the elastic deformation amount of the elastic supporting portion 4 is correspondingly larger than that in the case shown in FIG. 3*a*. Therefore, a biasing force magnitude F' which is applied to the antenna rotary shaft 10 from the antenna contact-and-connection portion 5 is larger than the biasing force magnitude F in the case shown in FIG. 3*a* (that is, F'>F).

Figure 4A:
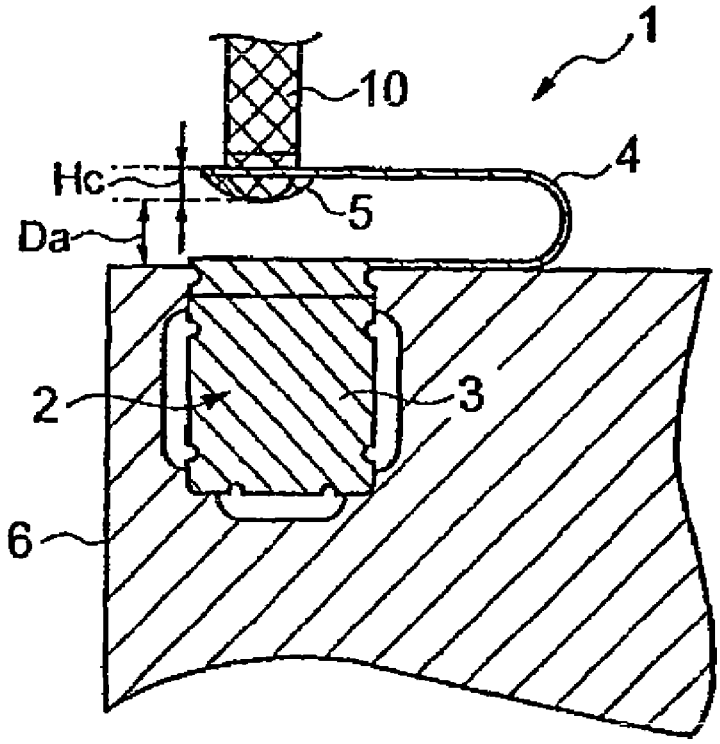
FIG. 4*a* illustrates, along with FIG. 4*b*, another example of adjusting the contact pressure between the antenna rotary shaft and the antenna contact-and-connection portion in the antenna feed structure according to the first embodiment.
Figure 4B:
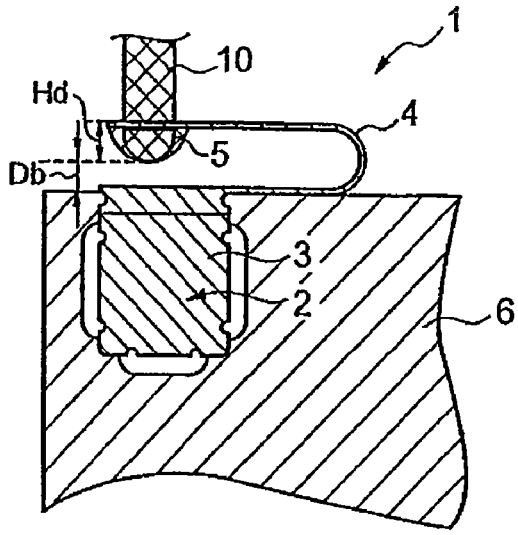
FIG. 4*b* illustrates, along with FIG. 4*a*, the another example of adjusting the contact pressure between the antenna rotary shaft and the antenna contact-and-connection portion in the antenna feed structure according to the first embodiment.

For example, when a design change causes the distance between the end of the antenna rotary shaft 10 and the end face of the circuit board 6 to become smaller, from a distance Da shown in FIG. 4*a* to a distance Db shown in FIG. 4*b*, if the depth of the recess wall 8 of the antenna contact-and-connection portion 5 remains the same as that prior to changing the design, that is, the same as Hc, the elastic deformation amount of the bent portion of the elastic supporting portion 4 increases. Therefore, the biasing force which is applied to the antenna rotary shaft 10 from the antenna contact-and-connection portion 5 is increased, as a result of which the contact pressure between the end of the antenna rotary shaft 10 and the recess wall 8 of the antenna contact-and-connection portion 5 is increased. In contrast, for example, as shown in FIG. 4*b*, a depth Hd of the recess wall 8 of the antenna contact-and-connection portion 5 is set greater than the depth Hc, which is the depth prior to changing the design, so that the elastic deformation amount of the bent portion of the elastic supporting portion 4 is the same as that in the state shown in FIG. 4*a*. By this, the magnitudes of the biasing forces which are applied to the antenna rotary shaft 10 from the antenna contact-and-connection portion 5 (that is, the magnitudes of the contact pressures between the end of the antenna rotary shaft 10 and the recess wall 8 of the antenna contact-and-connection portion 5) before and after changing the design are the same.

Accordingly, by adjusting the depth of the recess wall 8 of the antenna contact-and-connection portion 5, the magnitude of the biasing force which is applied to the antenna rotary shaft 10 from the antenna contact-and-connection portion 5, that is, the contact pressure between the end of the antenna rotary shaft 10 and the recess wall 8 of the antenna contact-and-connection portion 5 can be adjusted.

In the first embodiment, the curved recess wall 8 of the antenna contact-and-connection portion 5 and the curved end of the antenna rotary shaft 10 press-contact each other, and the antenna contact-and-connection portion 5 is supported by the elastically movable elastic supporting portion 4. This structure can provide the following advantage. For example, as shown in cross section in FIG. 5*b*, when the antenna rotary shaft 10 is in contact with and is connected to the antenna contact-and-connection portion 5 while a rotational center axis Lo of the antenna rotary shaft 10 passes through the position of a deepest portion O of the recess wall 8 of the antenna contact-and-connection portion 5, the antenna contact-and-connection portion 5 and the antenna rotary shaft 10 are in the most stably disposed state. In contrast, for example, when the antenna feed structure 1 is assembled, as shown in cross section in FIG. 5*a*, the state of contact and connection between the antenna rotary shaft 10 and the antenna contact-and-connection portion 5 sometimes becomes unstable due to the rotational center axis Lo of the antenna rotary shaft 10 and the position of the deepest portion O of the recess wall 8 of the antenna contact-and-connection portion 5 being shifted from each other. In such a case, in the structure according to the first embodiment, the antenna rotary shaft 10 and the antenna contact-and-connection portion 5 can be moved relative to each other in a direction in which they are disposed in a stable state by moving the end of the antenna rotary shaft 10 along the spherical recess wall 8 of the antenna contact-and-connection portion 5. In other words, the antenna rotary shaft 10 and the antenna contact-and-connection portion 5 can undergo self-alignment.

Figure 5A:
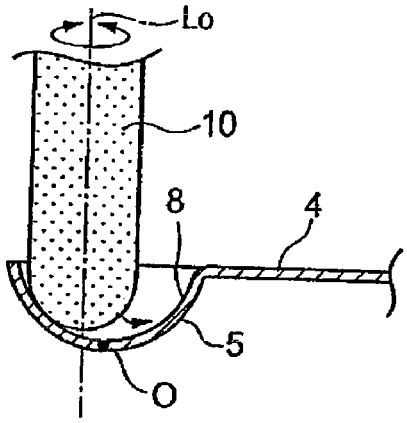
FIG. 5*a* illustrates, along with FIG. 5*b*, an advantage obtained by the antenna feed structure according to the first embodiment.
Figure 5B:
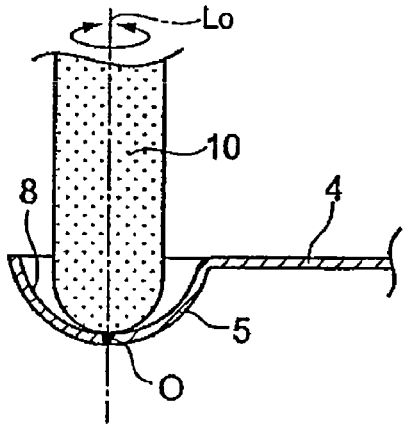
FIG. 5*b* illustrates, along with FIG. 5*a*, the advantage obtained by the antenna feed structure according to the first embodiment.

Even if, as shown in FIG. 5*a*, the rotational center axis Lo of the antenna rotary shaft 10 is shifted from the deepest portion O of the recess wall 8 of the antenna contact-and-connection portion 5 as a result of the antenna rotary shaft 10 being swung by the rotation of the antenna, it is possible for the antenna rotary shaft 10 and the antenna contact-and-connection portion 5 to similarly undergo self-alignment as mentioned above to thereby allow them to be disposed in the most stable state.

A second embodiment will hereunder be described. In the description of the second embodiment, corresponding parts to those in the first embodiment are given the same reference numerals, and common features thereof are not described below.

Figure 6A:
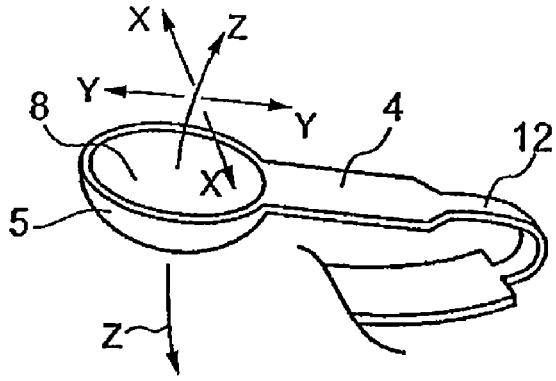
FIG. 6*a* is a schematic view of a form of an elastic supporting portion of a feeding metallic part in an antenna feed structure according to a second embodiment.

In the second embodiment, as shown in FIG. 6*a*, a bent portion 12 of an elastic supporting portion 4 is thinner than the other portions of the elastic supporting portion 4. Therefore, an antenna contact-and-connection portion 5 can be moved in three directions, the X, Y, and Z directions, which are perpendicular to each other. The Z direction is defined as the direction along which biasing force is applied to an antenna rotary shaft 10 from the antenna contact-and-connection portion 5 while the antenna contact-and-connection portion 5 is supported by a mounting portion 3 through the elastic supporting portion 4. In other words, the thin bent portion 12 of the elastic supporting portion 4 is a bendable portion.

Accordingly, by providing the elastic supporting portion 4 with the bendable portion 12, the antenna rotary shaft 10 and the antenna contact-and-connection portion 5 can more smoothly undergo self-alignment. This makes it easier to further stabilize the contact and connection between the antenna rotary shaft 10 and the antenna contact-and-connection portion 5. In the second embodiment, the structural features other than the structural feature related to the bendable portion 12 are the same as those in the first embodiment.

Figure 6B:
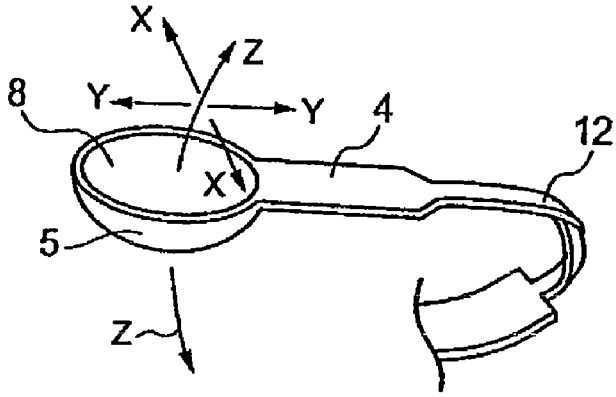
FIG. 6*b* is a schematic view of another form of the elastic supporting portion of the feeding metallic part in the antenna feed structure according to the second embodiment.

The form of the bendable portion 12 of the elastic supporting portion 4 is not limited to the form in the example shown in FIG. 6*a*. The bendable portion 12 may take any form as long as it allows the antenna contact-and-connection portion 5 to be moved in the three directions, the X, Y, and Z directions, which are perpendicular to each other. For example, as shown in FIG. 6*b*, it is possible for the bent bendable portion 12 of the elastic supporting portion 4, which is thinner than the other portions of the elastic supporting portion 4, to be twisted. By forming the bendable portion 12 in the form shown in FIG. 6*b*, the bendable portion 12 allows the antenna contact-and-connection portion 5 to be more smoothly moved in an X-Y plane than in the example shown in FIG. 6*a*, so that the antenna contact-and-connection portion 5 can be easily self-aligned.

A third embodiment will hereunder be described. In the description of the third embodiment, corresponding parts to those in the first and second embodiments are given the same reference numerals, and common features thereof are not described below.

Figure 7A:
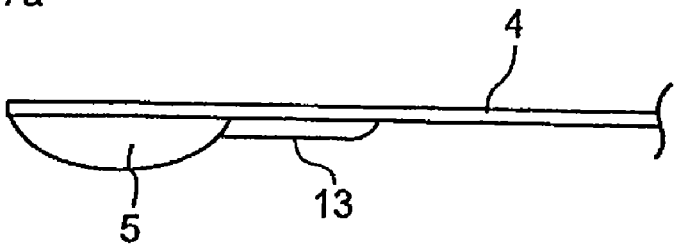
FIG. 7*a* is a side view illustrating a portion where an elastic supporting portion and an antenna contact-and-connection portion are connected together in an antenna feed structure according to a third embodiment.
Figure 7B:
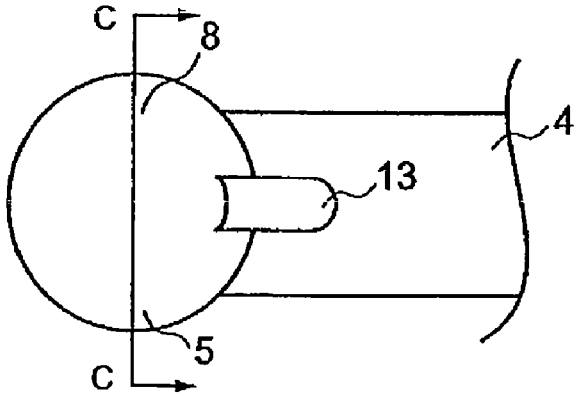
FIG. 7*b* is a schematic plan view of the portion where the elastic supporting portion and the antenna contact-and-connection portion are connected together as seen from the top side of FIG. 7*a*.
Figure 7C:
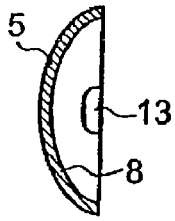
FIG. 7*c* is a schematic sectional view taken along the double-headed arrow C-C shown in FIG. 7*b*.

FIG. 7*a* schematically shows a portion where an elastic supporting portion 4 and an antenna contact-and-connection portion 5 are connected together, this portion being a distinctive feature of the third embodiment. FIG. 7*b* is a schematic plan view of the portion where the elastic supporting portion 4 and the antenna contact-and-connection portion 5 are connected together as seen from the top of FIG. 7*a*. FIG. 7*c* is a schematic sectional view taken along a double-headed arrow C-C shown in FIG. 7*b*. In the third embodiment, the portion where the elastic supporting portion 4 and the antenna contact-and-connection portion 5 are connected together is provided with a reinforcing rib 13 formed by extrusion.

Since a pushing force is applied to the antenna contact-and-connection portion 5 from the antenna rotary shaft 10, a force resulting from this pushing force is applied to the portion where the elastic supporting portion 4 and the antenna contact-and-connection portion 5 are connected together. This force may bend the portion where the elastic supporting portion 4 and the antenna contact-and-connection portion 5 are connected together. Therefore, biasing force which is applied to an antenna rotary shaft 10 from the antenna contact-and-connection portion 5 sometimes becomes weaker than a set value. In such a case, contact pressure between an end of the antenna rotary shaft 10 and a recess wall 8 of the antenna contact-and-connection portion 5 is reduced. The reduction in the contact pressure no longer allows the antenna rotary shaft 10 to be properly in contact with and connected to the antenna contact-and-connection portion 5. Therefore, there is sometimes concern about connection failure in which the state of connection between an antenna and a circuit formed at a circuit board is deteriorated.

Accordingly, in the third embodiment, the portion where the elastic supporting portion 4 and the antenna contact-and-connection portion 5 are connected together is provided with the reinforcing rib 13. This reinforces the portion where the elastic supporting portion 4 and the antenna contact-and-connection portion 5 are connected together, thereby making it possible to prevent the portion where the elastic supporting portion 4 and the antenna contact-and-connection portion 5 are connected together from being bent due to the pushing force from the antenna rotary shaft 10. Therefore, the state of contact and connection between the antenna rotary shaft 10 and the antenna contact-and-connection portion 5 can be easily maintained under a design contact pressure between the antenna rotary shaft 10 and the antenna contact-and-connection portion 5. As a result, the antenna and the circuit formed at the circuit board can be more reliably electrically connected through the antenna feed structure 1.

In the third embodiment, the structural features other than the structural feature related to the reinforcing rib 13 are the same as those in the first and second embodiments.

A fourth embodiment will hereunder be described. In the description of the fourth embodiment, corresponding parts to those in the first to third embodiments are given the same reference numerals, and common features thereof are not described below.

Figure 8:
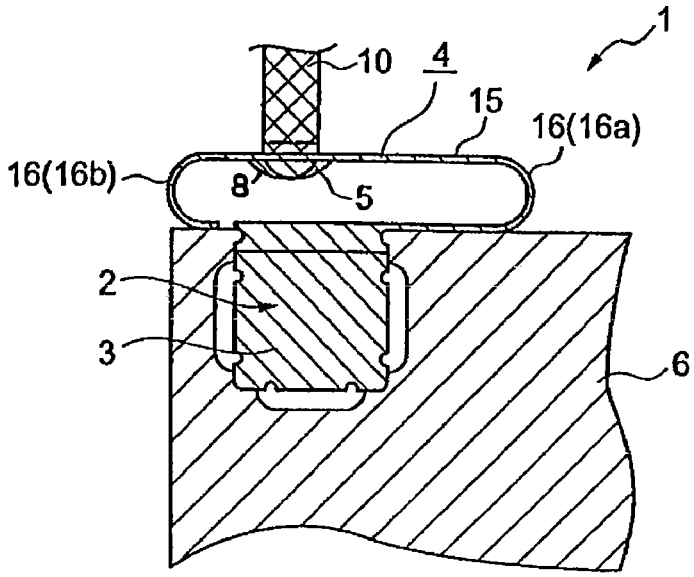
FIG. 8 is a model view illustrating an antenna feed structure according to a fourth embodiment.

In the fourth embodiment, as shown in FIG. 8, an elastic supporting portion 4 has an antenna receiving plate 15 and elastic portions 16 (16*a* and 16*b*). The antenna receiving plate 15 is disposed apart from and extends parallel with an end face of a circuit board 6. The elastic portions 16 (16*a* and 16*b*) are bent back at respective end portions of the antenna receiving plate 15.

A spherical recess wall 8 is formed at a portion of a surface of the antenna receiving plate 15 to form an antenna contact-and-connection portion 5 thereat. An end of the elastic portion 16*a* is connected to a mounting portion 3. An end of the elastic portion 16*b* is in contact with the end face of the circuit board 6. Accordingly, the antenna contact-and-connection portion 5 is supported at both ends by the elastic supporting portion 4. Alternatively, the end of the elastic portion 16*b* may be connected to the mounting portion 3 instead of being in contact with the end face of the circuit board 6.

In the fourth embodiment, when an end of an antenna rotary shaft 10 comes into press-contact with the recess wall 8 of the antenna contact-and-connection portion 5, biasing force is applied to the end of the antenna rotary shaft 10 from the antenna contact-and-connection portion 5 on the basis of elastic forces of the elastic portions 16*a* and 16*b*.

The structural features other than the structural feature of the antenna contact-and-connection portion 5 being supported at both ends by the elastic supporting portion 4 are the same as those in the first to third embodiments. That is, for example, as in the second embodiment, the elastic portions 16 may be formed so as to function as the bendable portion 12 of the elastic supporting portion 4, or, as in the third embodiment, the portion where the elastic supporting portion 4 and the antenna contact-and-connection portion 5 are connected together may be provided with a reinforcing rib 13.

In the fourth embodiment, since the antenna contact-and-connection portion 5 is elastically supported at both ends, the antenna contact-and-connection portion 5 can be more stably disposed. In addition, compared to the case in which the antenna contact-and-connection portion 5 is supported at one end, it is possible to increase the biasing force with which the antenna contact-and-connection portion 5 is provided.

The invention is not limited to the first to fourth embodiments, so that the invention is capable of various other embodiments. For example, although, in the first to fourth embodiments, the antenna feed structure 1 according to the invention is installed in a card device, it may be installed in other wireless communication devices instead of in the card device.

The present invention may be applied to an antenna feed structure of a wireless communication device including a rotatable antenna. By virtue of the structure according to the present invention, it is possible to more reliably electrically connect the antenna and a circuit formed at the circuit board and to simply and reliably connect the antenna rotary shaft and the feeding metallic part. Therefore, the present invention is particularly effective when applied to an antenna feed structure of a small wireless communication device.

Although the present invention has been described in relation to particular embodiments thereof, many other variations and modifications and other uses will become apparent to those skilled in the art. Therefore, the present invention is not limited by the specific disclosure herein.

What is claimed is:

1. An antenna feed structure for electrically connecting a rotatable antenna having a conductive antenna rotary shaft protruding from the antenna, an end of the antenna rotary shaft being rounded, to a circuit formed on a circuit board, the antenna feed structure comprising:

a feeding metallic part having a mounting portion, an antenna contact-and-connection portion, and an elastic supporting portion, the mounting portion being mounted to the circuit board, the antenna contact-and-connection portion being disposed for being brought into contact with and electrically connected to the end of the antenna rotary shaft, the elastic supporting portion supporting the antenna contact-and-connection portion at the mounting portion and producing biasing force towards the antenna rotary shaft from the antenna contact-and-connection portion, the antenna contact-and-connection portion of the feeding metallic part having a recess wall having a rounded shape for engaging with the rounded shape of the end of the antenna rotary shaft.

2. The antenna feed structure according to claim 1, wherein the elastic supporting portion of the feeding metallic part has an antenna receiving plate and elastic portions, the antenna receiving plate being disposed apart from and extending parallel with an end face of the circuit board, the elastic portions being formed by bending back respective end portions of the antenna receiving plate and by disposing an end of each bent portion so that the end of each bent portion either contacts the end face of the circuit board or is connected to the mounting portion of the feeding metallic part, wherein the antenna contact-and-connection portion is formed by forming a rounded recess wall at a portion of a surface of the antenna receiving plate, and wherein at least one of the elastic portions at the respective end portions of the antenna receiving plate is conductively connected to the mounting portion.

3. The antenna feed structure according to claim 1, wherein a portion where the elastic supporting portion and the antenna contact-and-connection portion are connected together is provided with a reinforcing rib.

4. The antenna feed structure according to claim 2, wherein a portion where the elastic supporting portion and the antenna contact-and-connection portion are connected together is provided with a reinforcing rib.

5. The antenna feed structure according to claim 1, wherein the elastic supporting portion has a bendable portion, the bendable portion permitting the antenna contact-and-connection portion to move in three directions, X, Y and Z directions, which are perpendicular to each other, wherein a direction in which the biasing force is applied to the antenna rotary shaft from the antenna contact-and-connection portion while the antenna contact-and-connection portion is supported at the mounting portion is defined as the Z direction.

6. The antenna feed structure according to claim 2, wherein the elastic supporting portion has a bendable portion, the bendable portion permitting the antenna contact-and-connection portion to move in three directions, X, Y and Z directions, which are perpendicular to each other, wherein a direction in which the biasing force is applied to the antenna rotary shaft from the antenna contact-and-connection portion while the antenna contact-and-connection portion is supported at the mounting portion is defined as the Z direction.

7. In combination, the antenna feed structure of claim 1, further comprising a rotatable antenna having a conductive antenna rotary shaft protruding from the antenna, an end of the antenna rotary shaft being rounded, the rounded end of the antenna rotary shaft being conductively press-contacted to the rounded end of the antenna rotary shaft against the rounded recess wall of the antenna contact-and-connection portion.

8. The antenna feed structure according to claim 5, wherein said bendable portion includes a twisted portion.

9. The antenna feed structure according to claim 6, wherein said bendable portion includes a twisted portion.

10. The antenna feed structure according to claim 1, wherein said rounded recess wall shape is spherical.

11. The antenna feed structure according to claim 2, wherein said rounded shapes of the end of the antenna rotary shaft and of the recess wall are spherical.

12. A feeding antenna part for being mounted on a circuit board for electrically connecting a rotatable antenna having a conductive antenna rotary shaft protruding from the antenna, an end of the antenna rotary shaft being rounded, to a circuit formed on the circuit board, the feeding metallic part having a mounting portion configured for being mounted to the circuit board, an antenna contact-and-connection portion, and an elastic supporting portion, the antenna contact-and-connection portion being configured for being brought into contact with and electrically connected to the end of the antenna rotary shaft, the elastic supporting portion for supporting the antenna contact-and-connection portion at the mounting portion and for producing biasing force towards the antenna rotary shaft from the antenna contact-and-connection portion, the antenna contact-and-connection portion of the feeding metallic part having a recess wall having a rounded shape for engaging with the rounded shape of the end of the antenna rotary shaft.

13. A feeding antenna part according to claim 12, further comprising a rotatable antenna having a conductive antenna rotary shaft protruding from the antenna, an end of the antenna rotary shaft being rounded, the rounded end of the antenna rotary shaft being conductively press-contacted to the rounded end of the antenna rotary shaft against the rounded recess wall of the antenna contact-and-connection portion.

14. A feeding antenna part according to claim 13, said feeding antenna part being mounted on and conductively connected to a circuit on a circuit board.

15. A feeding antenna part according to claim 12, said feeding antenna part being mounted on and conductively connected to a circuit on a circuit board.

* * * * *